US006968143B2

(12) United States Patent
Blair et al.

(10) Patent No.: US 6,968,143 B2
(45) Date of Patent: Nov. 22, 2005

(54) AUTOMATIC MEDIA ALIGNMENT NIP RELEASE MECHANISM

(75) Inventors: Brian Allen Blair, Richmond, KY (US); Jeffrey L. Tonges, Versailles, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 55 days.

(21) Appl. No.: 10/804,298

(22) Filed: Mar. 19, 2004

(65) Prior Publication Data

US 2005/0207787 A1 Sep. 22, 2005

(51) Int. Cl.[7] ..... G03G 15/00; G03G 21/00
(52) U.S. Cl. ..... 399/124; 399/303; 399/313
(58) Field of Search ..... 399/75, 124, 388, 399/297, 303, 313

(56) References Cited

U.S. PATENT DOCUMENTS 4,966,358 A 10/1990 Yokoi et al.
5,300,998 A * 4/1994 Ogisawa et al. ..... 399/124
5,362,041 A 11/1994 Ryuzaki et al.
5,384,630 A 1/1995 Nakamura et al.
5,708,946 A 1/1998 Cahill et al.
5,752,135 A 5/1998 Coffey et al.
6,253,046 B1 6/2001 Horrall et al.
6,343,787 B1 2/2002 Kato et al.
2004/0218944 A1 * 11/2004 Kawaguchi et al. ..... 399/90

* cited by examiner

*Primary Examiner*—Christopher W. Fulton
*Assistant Examiner*—Yaritza Guadalupe
(74) *Attorney, Agent, or Firm*—Coats & Bennett, PLLC

(57) ABSTRACT

In an image forming apparatus having a subunit movable between closed and open positions, the nip between media alignment rollers is opened automatically when the subunit is opened. A drive roller and a backup roller are disposed in a housing, wherein the bearing holding the backup roller is segmented. A rear segment is disposed on a flexible arm, and is biased towards the front segment, biasing the backup roller to contact the drive roller to form a nip for bump alignment of media sheets. A bell crank engages a rotary member or rotary member frame mounted on the subunit when the subunit is closed. When the subunit is opened, the bell crank disengages the member, pivoting a link member having a cam surface and engaging the cam surface against a cam follower surface on the housing, forcing the backup roller to a position spaced apart from the drive roller.

21 Claims, 5 Drawing Sheets

AUTOMATIC MEDIA ALIGNMENT NIP RELEASE MECHANISM

BACKGROUND

The present invention relates generally to the field of image formation and in particular to an automatic media alignment nip release mechanism.

Media sheets in image formation devices are preferably aligned to eliminate skew. That is, the leading edge of the media sheet is aligned to be parallel to the axes of the photoconductive members used to transfer developed images to the media sheet. A media sheet is aligned if, when crossing a line across the media path perpendicular to direction of travel, the leading edge of the media sheet encounters the line at the same time along its extent. A media sheet is skewed if, for example, when crossing such a line, one of the leading corners of the media sheet encounters the line before the other leading corner.

One method of media sheet alignment known in the art is referred to herein as "bump alignment." A media sheet is directed to the nip formed between two rollers, the surfaces of which are in contact along their length. The media sheet is briefly driven after the leading edge has contacted the nip of rollers, causing a "bump" or curvature, to form in the media sheet. This deformation of the media sheet exerts a forward force on the leading edge of the sheet, forcing it against the nip of the rollers. The malleability of the deformation allows either leading corner to advance slightly, relative to and independently of the other leading corner, until the leading edge is flush with the nip along its entire length, thus eliminating any skew in the positioning of the leading edge relative to the axes of the two rollers. At least one of the rollers is then driven, capturing the leading edge of the media sheet simultaneously along the nip, and passing the media sheet along in an aligned orientation.

In some cases, a registration function may be combined with the media sheet alignment function. Registration refers to the timing of advancing a media sheet into the image formation path. Advancing a media sheet from a known position (the nip of the alignment/registration rollers) at a specific time provides a precise temporal demarcation against which downstream image formation processes may be referenced, to ensure high quality image formation (such as, for example, ensuring accurate registration of plural color planes transferred at plural image formation stations).

To function properly, the alignment nip must be formed with a relatively high nip force. This presents a difficulty in clearing jams, as the alignment rollers grip the media sheet tightly. Additionally, in image forming devices wherein parts of the media sheet travel path separate, such as when a door or other subunit on which some elements are mounted is opened or otherwise moved away from the main housing, damage may result if a media sheet spans the separation point, and is being tightly held in the alignment nip.

SUMMARY

The present invention relates to an image forming apparatus having an apparatus housing and a subunit moveable between open and closed positions with respect to said apparatus housing. The image forming apparatus includes a drive roller and backup roller disposed adjacent and parallel in the apparatus housing, a transport roller mounted in a frame and operative to guide a media transport belt, and a mechanical linkage connected to the backup roller and operative to engage and disengage the transport roller frame.

The mechanical linkage is also operative to move the backup roller between an engaged position wherein the backup roller contacts the drive roller to form a nip therebetween, and a retracted position wherein the backup roller does not contact the drive roller, in response to the mechanical linkage disengaging the transport roller frame.

In another aspect, the present invention relates to a media alignment mechanism for an image forming apparatus having a subunit moveable between open and closed positions. The mechanism includes a housing having a continuous bearing, a segmented bearing and a cam follower surface. A drive roller is disposed in the continuous bearing. A backup roller having a shaft is disposed in the segmented bearing, adjacent and parallel to the drive roller, and moveable between an engaged position wherein the backup roller contacts the drive roller to form a nip therebetween, and a retracted position wherein the backup roller does not contact the roller, in response to the subunit moving from a closed to an open position. The mechanism also includes a biasing member operative to bias the backup roller to the engaged position.

In yet another aspect, the present invention relates to a method of releasing a media sheet from nip between two rollers disposed in an image formation apparatus having a subunit movable between closed and open positions. The method includes engaging and disengaging an element mounted on the subunit with a mechanical linkage disposed in the housing as the subunit is moved between closed and open positions. The method further includes, in response to engaging or disengaging the element, moving one of the rollers between an engaged position in which it forms a nip with the other roller and a retracted position in which it is spaced apart from the other roller, thereby releasing the media sheet from the nip when the one roller is in the retracted position.

DETAILED DESCRIPTION

The disclosure of copending patent application Ser. No. 10/804,488 entitled "Image Forming Device Having A Door Assembly And Method Of Use", filed concurrently herewith and assigned to the assignee of the instant application, is hereby incorporated by reference in its entirety.

Figure 1:
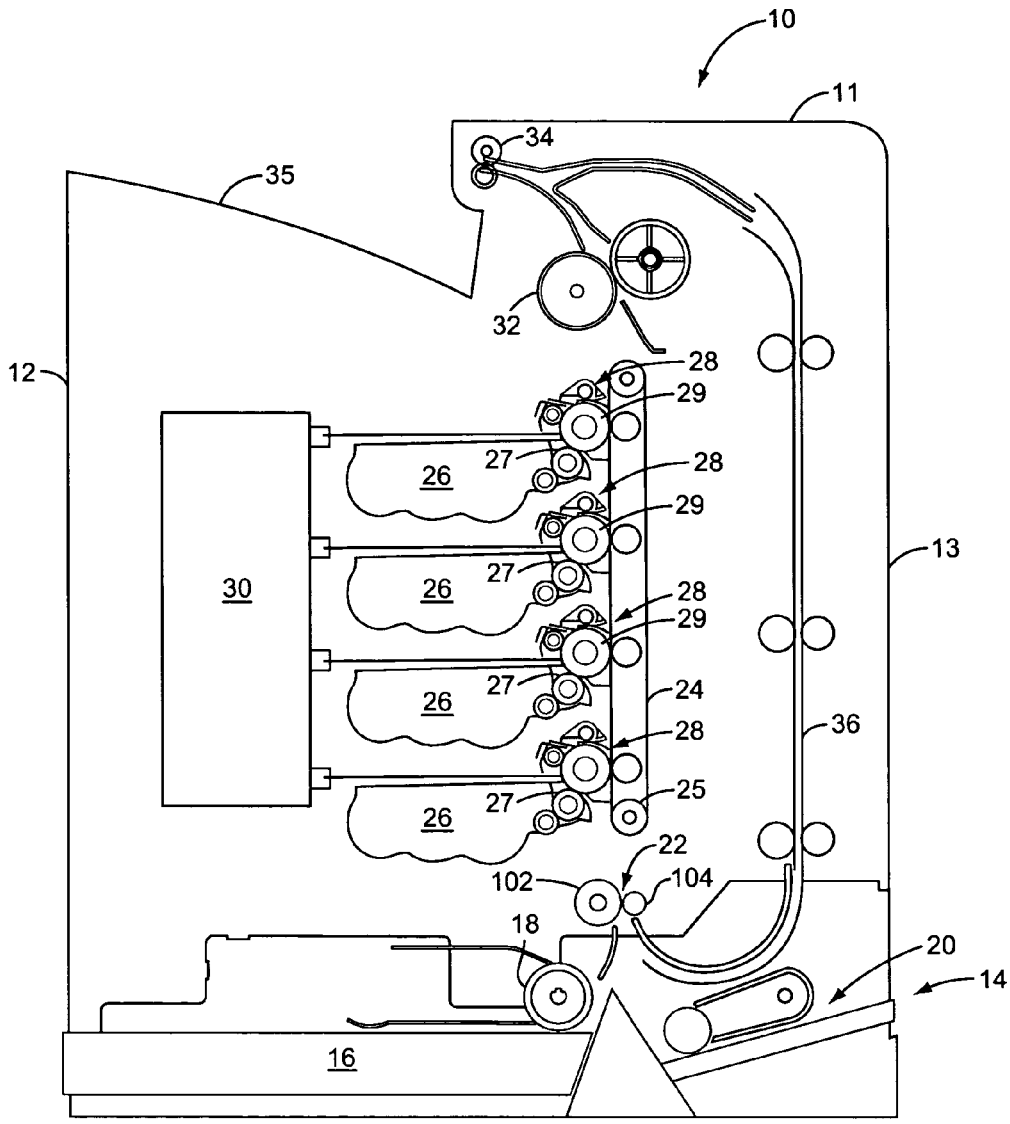
FIG. 1 is a schematic diagram of a representative image forming apparatus having alignment rollers.

FIG. 1 depicts a representative image forming apparatus, indicated generally by the numeral 10. The image forming apparatus 10 comprises a housing 12 with a top portion 11, subunit 13 movable between open and closed positions with respect to the housing 12 and a media tray 14. The media tray 14 includes a main media sheet stack 16 with a sheet pick mechanism 18, and a multipurpose tray 20 for feeding envelopes, transparencies and the like. The media tray 14 is preferably removable for refilling, and located on a lower section of the device 10.

Within the image forming apparatus body 12 and/or in the subunit 13, the image forming apparatus 10 includes media registration mechanism 22 comprising driver roller 102 and backup roller 104, a media sheet transfer belt 24 with transfer belt roller 25, one or more removable developer units 26, a corresponding number of removable photoconductor units 28, an imaging device 30, a fuser 32, reversible exit rollers 34, and a duplex media sheet path 36, as well as various rollers, actuators, sensors, optics, and electronics (not shown) as are conventionally known in the image forming apparatus arts, and which are not further explicated herein.

Each developer unit 26 mates with a corresponding photoconductor unit 28, with the developer unit 26 developing a latent image on the surface of a photoconductive member in the photoconductor unit 28 by supplying toner. In a typical color printer, three or four colors of toner—cyan, yellow, magenta, and optionally black—are applied successively (and not necessarily in that order) to a print media sheet to create a color image. Correspondingly, FIG. 1 depicts four pairs of developer units 26 and photoconductor units 28.

The operation of the image forming apparatus 10 is conventionally known. Upon command from control electronics, a single media sheet is "picked," or selected, from either the primary media stack 16 or the multipurpose tray 20. Alternatively, a media sheet may travel through the duplex path 36 for a two-sided print operation. Regardless of its source, the media sheet is presented at the nip of a media alignment mechanism 22, which aligns the media sheet and precisely times its passage on to the image forming stations downstream. The media alignment mechanism 22 may also be referred to in the art as one or more registration rollers.

After media sheet passes the media alignment mechanism 22 it contacts the transport belt 24, which carries the media sheet successively past the photoconductor units 28. At each photoconductor unit 28, a latent image is formed by the imaging device 30 and optically projected onto a photoconductive member. The latent image is developed by applying toner to the photoconductive member from the corresponding developer unit 26. The toner is subsequently deposited on the media sheet as it is conveyed past the photoconductor unit 28 by the transport belt 24.

The toner is thermally fused to the media sheet by the fuser 32, and the sheet then passes through reversible exit rollers 34, to land facedown in the output stack 35 formed on the exterior of the image forming apparatus body 12. Alternatively, the exit rollers 34 may reverse motion after the trailing edge of the media sheet has passed the entrance to the duplex path 36, directing the media sheet through the duplex path 36 for the printing of another image on the back side thereof.

Figure 2:
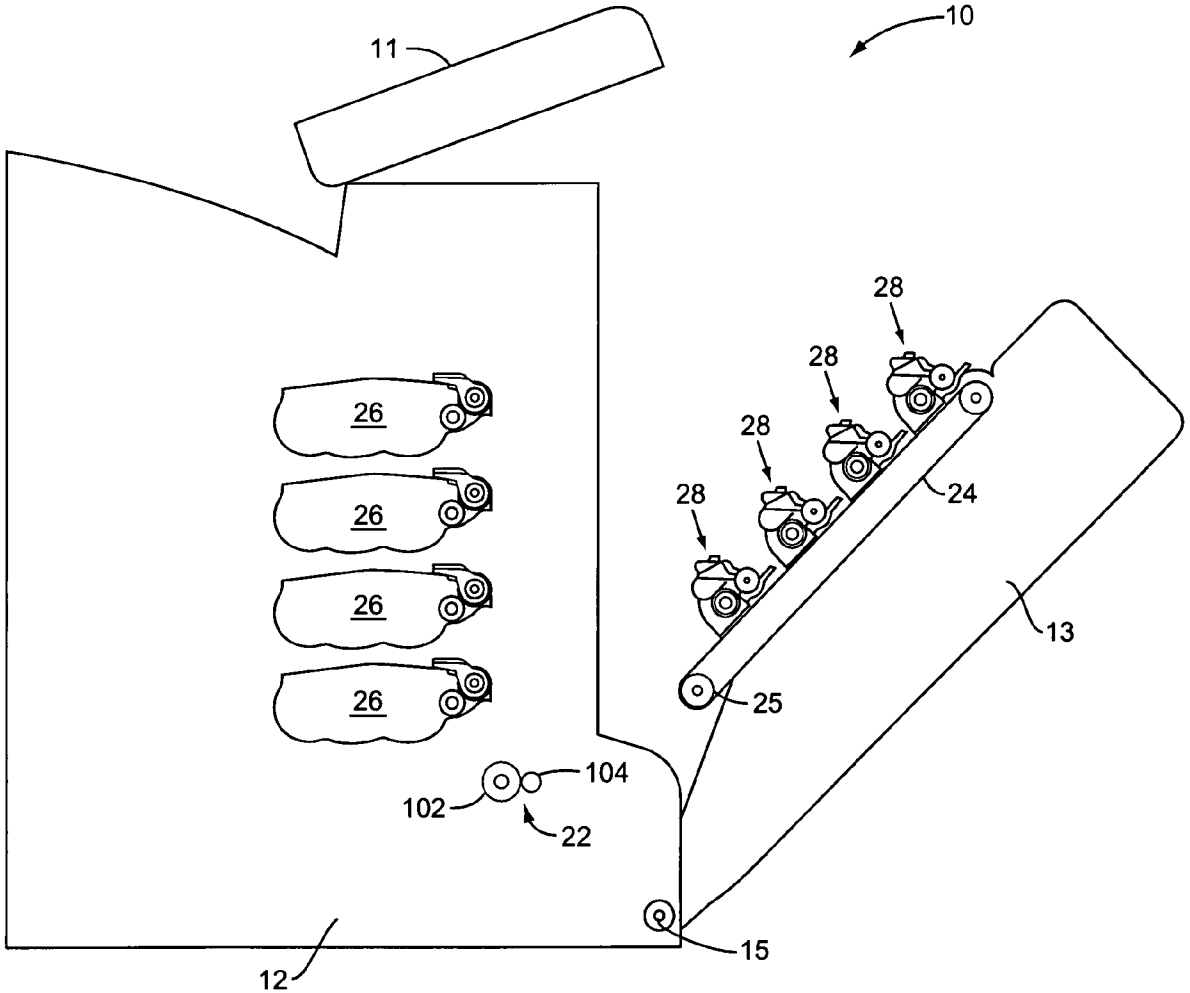
FIG. 2 is a schematic diagram of a representative image forming apparatus having a subunit movable between open and closed positions.

FIG. 2 depicts the image forming apparatus 10 with the subunit 13 in an open position, in which it is separated from the main housing 12 by pivoting about a hinge point 15. At least the media sheet transport belt 24, a transport roller 25 and the photoconductor units 28 are mounted to the subunit 13.

Figure 3:
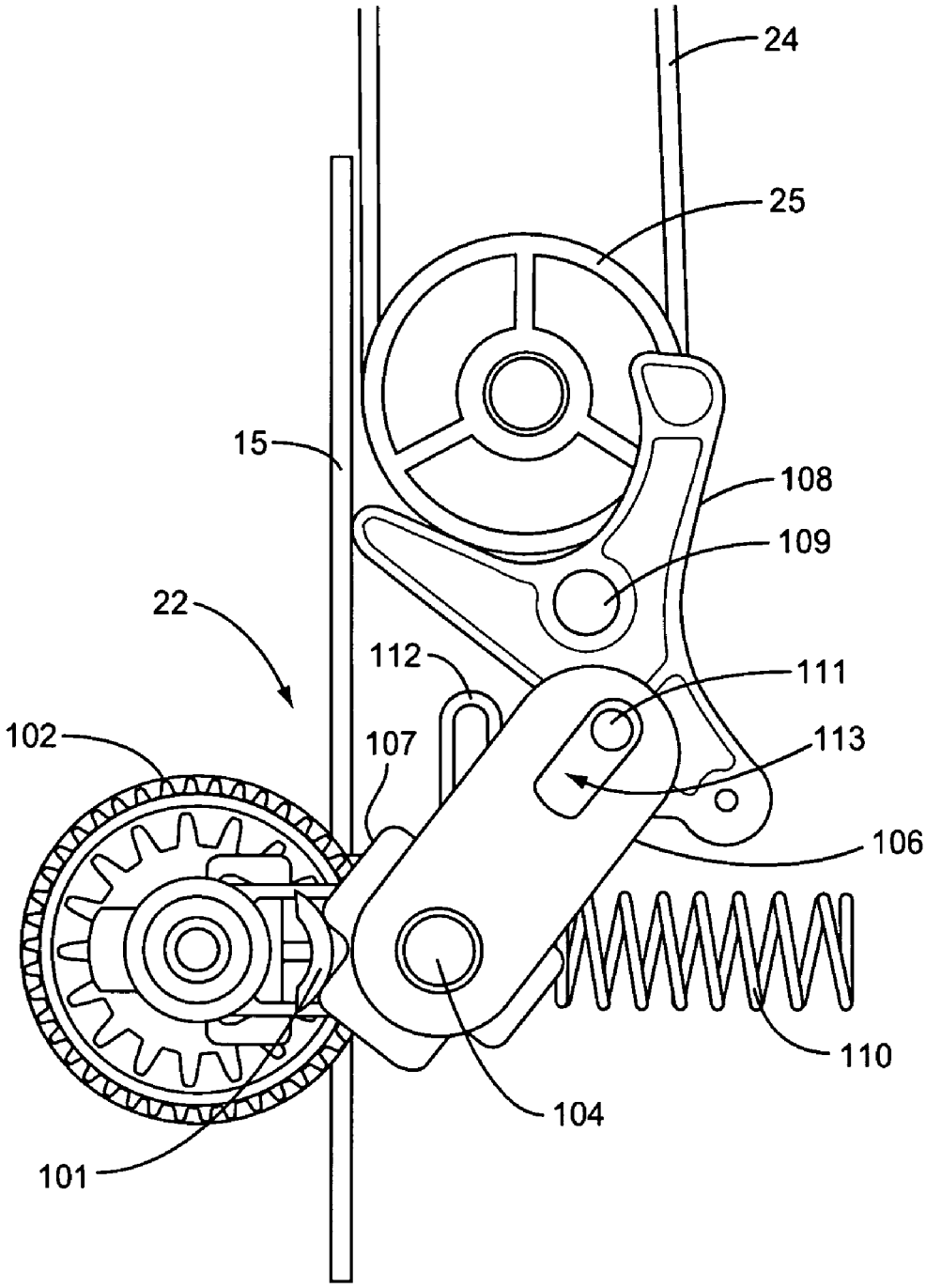
FIG. 3 is a schematic view of a media alignment mechanism wherein a backup roller is in an engaged position.

FIG. 3 depicts the media alignment mechanism 22 when the subunit 13 is in a closed position, placing the media transport belt 24 above the media alignment mechanism 22. FIG. 3 also depicts a media sheet 15 passing through the media alignment mechanism 22 and contacting the transport belt 24. The media alignment mechanism 22 comprises a media alignment housing 100 (see FIG. 5), drive roller 102, backup roller 104 and biasing member 110. The drive roller 102 and backup roller 104 are disposed in the media alignment housing 100, in drive roller bearing 103 and backup roller bearing 105, respectively.

Figure 5:
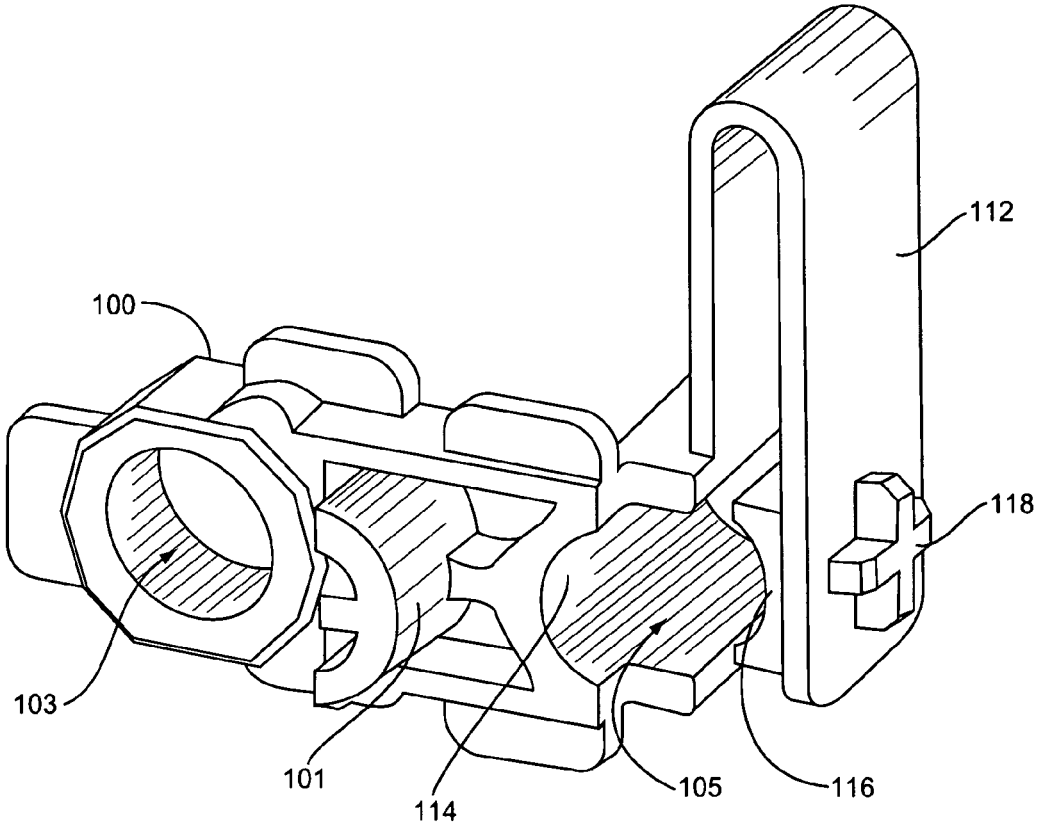
FIG. 5 is a perspective view of a media alignment housing.

As shown in FIG. 5, unlike the drive roller bearing 103, the backup roller bearing 105 does not extend in a continuous manner around the full circumference. Rather, the backup roller bearing 105 comprises a front segment 114 formed in the main media alignment housing 100 and a rear segment 116 attached to a flexible roller holder 112 extending from the media alignment housing 100. Such a bearing is referred to herein as a "segmented bearing." The rear segment 116 is operative to move, via slight deformation of the flexible roller holder 112, from a position abutting the front segment 114 to a position spaced apart from the front segment 114. The flexible roller holder 112 may additionally include a biasing member locator 118 disposed opposite the rear backup roller bearing segment 116. The biasing member 110 is positioned over the biasing member locator 118 at one end, with the other end positioned against the image forming apparatus housing 12 or some rigid body affixed thereto.

As FIG. 3 depicts, the media alignment mechanism 22 is mechanically linked to the transport belt 24 and transport roller 25 disposed on the subunit 13 by a link member 106 and bell crank 108. This mechanical linkage, described in detail below, is operative to move the backup roller 104 between an engaged position when the subunit 13 is closed and a retracted position when the subunit 13 is open. In the engaged position, the backup roller 104 presses against the drive roller 102 to form a media alignment nip therebetween. The roller 104 is biased to the engaged position by the biasing member 110, which may comprise for example a spring in compression. The biasing member 110 additionally provides a nip force between the backup roller 104 and the drive roller 102. In a retracted position, the backup roller does not contact the drive roller 102.

The backup roller 104 is moved between the engaged and retracted positions by actuation of a cam surface 107 on the link member 106 with a cam follower surface 101 formed on the media alignment housing 100. As shown in FIG. 3, the cam surface 107 does not engage with the cam follower surface 101 when the subunit 13 is closed.

As the subunit 13 moves from an open to a closed position, the bell crank 108, disposed in the image forming apparatus housing 12, engages the frame holding the transport roller 25, disposed on the subunit 13, and precisely locates the transport roller 25 within the assembly housing 12 (alternatively, the bell crank 108 may engage the transport roller 25 directly). This positions the transport belt 24 over the media alignment mechanism 22, as shown in FIG. 3. Note that the media sheet 15 is both engaged in the media alignment mechanism 22 and in contact with the transport belt 24.

Because the bump alignment function of the media alignment mechanism 22 requires a relatively high nip force between the drive roller 102 and backup roller 104, jammed media sheets 15 are difficult to remove from the media alignment mechanism 22. In addition, if the subunit 13 were opened with a media sheet 15 advanced past the first image forming station, the media sheet 15 may be electrostatically adhered to the transport 24, or alternatively may be held by a force between the photoconductive member 29 and a transfer roller opposite transport belt 24 from the photoconductive member 29. In either case, as the transport belt 24 (mounted on the subunit 13) moves away from the apparatus housing 12, if the media sheet is fixed in the media alignment mechanism 22, it may slip on the transport belt 24. This has the potential to damage one of the photoconductive members in a photoconductor unit 28, or to dislodge a photoconductor unit 28 from its mounting position on the subunit 13. According to the present invention, such damage or dislodging is avoided by automatically moving the backup roller 104 of the media alignment mechanism 22 to a retracted position, releasing the nip force between it and the drive roller 102, releasing the media sheet and allowing it to be carried on the transport belt 24, for easy removal by an operator.

Figure 4:
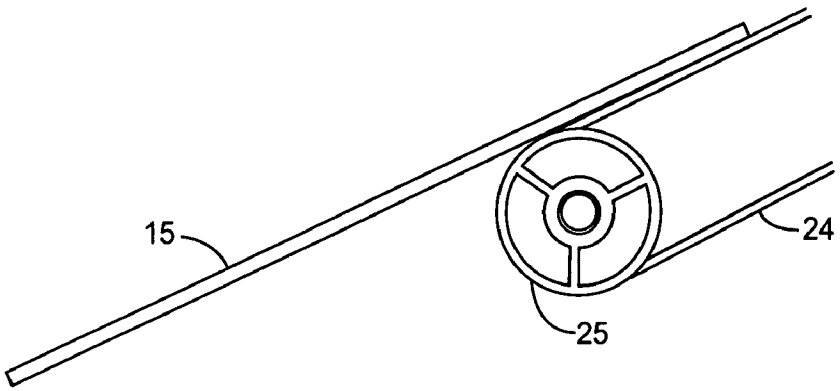
FIG. 4 is a schematic view of a media alignment mechanism wherein a backup roller is in a retracted position.
Figure 4:
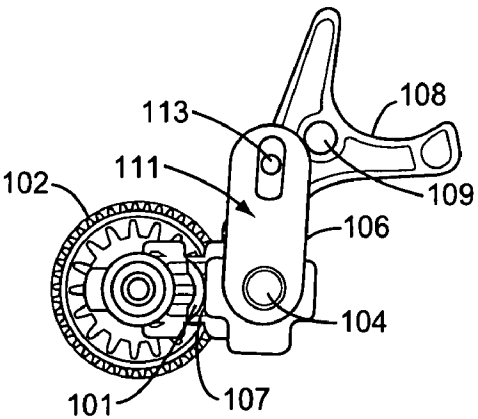

As the subunit 13 opens and the transport roller 25 moves away from the media alignment mechanism 22, the bell crank 108 rotates in a clockwise direction about point 109, as depicted in FIG. 4. The bell crank 108 is mechanically linked to the link member 106, and causes the link member 106 to pivot the about the axis of the backup roller 104 in a counterclockwise direction as depicted in FIG. 4. This actuates the cam surface 107 on the link member 106 against the cam follower surface 101 on the media alignment housing 100, forcing the backup roller 104 to translate laterally away from the drive roller 102, to the right as depicted in FIG. 4, to a retracted position. In this position, the media sheet 15 may be easily removed from the media alignment mechanism 22. Additionally, if the media sheet 15 is in contact with the transport belt 24, it may freely exit the media alignment mechanism 22 as the subunit 13 is opened, avoiding damage to components mounted adjacent the transport belt 24.

The backup roller 104 translates laterally away from the drive roller 102 via the separation of the backup roller bearing 105 into a separate front segment 114 and rear segment 116, as depicted in FIG. 5. The rear segment 116 is affixed to the flexible roller holder 112, which permits of the slight distortion necessary to translate the backup roller 104. Preferably, in the fully retracted position, the backup roller 104 is spaced apart from the drive roller 102 by about 1 mm. However, in other embodiments, the backup roller 104 may be spaced a greater or lesser distance. In some embodiments, the retracted position may merely counter the nip force, leaving the drive roller 102 and backup roller 104 in nip contact.

When the subunit 13 is again closed, the bell crank 108 engages a frame holding the transport roller 25, rotating counterclockwise about point 109. This pivots the link member 106 about the axis of the backup roller 104 (clockwise as depicted in FIGS. 3 and 4), disengaging the cam surface 107 from the cam follower surface 101. Referring to FIG. 5, the biasing member locator 118 on the flexible roller holder 112, is opposite the rear segment 116 of the backup roller bearing 105. When the biasing member 110 (see FIG. 3) is positioned between the biasing member locator 118 and a rigid element of the housing 12 of the image formation apparatus 10, it urges the rear segment 116 of the backup roller bearing 105 against the backup roller 104, translating the backup roller 104 to the left as viewed in FIGS. 2–5, to an engaged position against the drive roller 102, forming a nip therebetween. The biasing member 110 continues to urge the backup roller 104 against the drive roller 102, generating the nip force necessary for the bump alignment function of the media alignment mechanism 22.

The present invention has been described herein with respect to an embodiment of the image forming apparatus in which developer units 26 are disposed within the housing 12 and photoconductor units 28 are disposed on an openable subunit. The present invention is not limited to this embodiment. For example, the image formation apparatus 10 may include integrated removable cartridges, each including toner, a developer roller and a photoconductive member. These cartridges may be mounted in the housing 10, with only the transport belt 24 and transport roller 25 disposed on the openable subunit. Those of skill in the art will be readily recognize other possible configurations within the scope of the present invention.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming apparatus having an apparatus housing and a subunit moveable between open and closed positions with respect to said apparatus housing, comprising:

a drive roller and backup roller disposed adjacent and parallel in said apparatus housing;

a transport roller mounted in a frame and operative to guide a media transport belt; and a mechanical linkage connected to said backup roller and operative to engage and disengage said transport roller frame, said linkage also operative to move said backup roller between an engaged position wherein said backup roller contacts said drive roller to form a nip therebetween, and a retracted position wherein said backup roller does not contact said drive roller, in response to said mechanical linkage disengaging said transport roller frame.

2. The apparatus of claim 1 further comprising a media alignment housing in which said drive roller and said backup roller are disposed.

3. The apparatus of claim 2 wherein said media alignment housing includes a cam follower surface.

4. The apparatus of claim 3 wherein said mechanical linkage includes a link member pivotally affixed to a shaft of said backup roller, and operative to pivot about the axis of said backup roller.

5. The apparatus of claim 4 wherein said link member includes a cam surface operative to contact said cam follower surface as said link member pivots about the axis of said backup roller, moving said backup roller from an engaged to a retracted position.

6. The apparatus of claim 5 wherein said media alignment housing includes a segmented bearing comprising a front and rear segment, in which said backup roller is disposed, the rear segment of which is disposed on a flexible roller holder operative move said rear segment from an engaged position wherein said backup roller is proximate said front segment to a retracted position wherein said backup roller is spaced from said front segment.

7. The apparatus of claim 5 further comprising a biasing member operative to bias said backup roller to an engaged position and to apply a nip force between said backup roller and said driver roller when said backup roller in the engaged position.

8. The apparatus of claim 5 wherein said link member pivots about the axis of said backup roller to move said backup roller from an engaged to a retracted position in response to said mechanical linkage disengaging said transport roller frame.

9. The apparatus of claim 8 wherein said transport roller frame is disposed on said subunit, and said mechanical linkage disengages said transport roller frame when said subunit is moved from a closed to an open position.

10. The apparatus of claim 9 said mechanical linkage further includes a bell crank member disposed in said apparatus housing and connected to said link member, said bell crank member operative to engage said transport roller frame as said subunit is moved from an open to a closed position, and to pivot said link member about the axis of said backup roller to move said backup roller from a retracted to an engaged position.

11. The apparatus of claim 10 wherein as said subunit is moved from a closed to an open position, said transport roller frame disengages from said bell crank member by rotating said bell crank member, which pivots said link member about the axis of said backup roller, engaging said cam surface with said cam follower surface to move said backup roller from an engaged to a retracted position.

12. The apparatus of claim 1 wherein media sheets are aligned by forcing a leading edge of said media sheet against the nip formed between said drive roller and said backup roller when said backup roller is in an engaged position, prior to advancing said media sheet by rotating said drive roller.

13. A media alignment mechanism for an image forming apparatus having a subunit moveable between open and closed positions, comprising:

a housing having a continuous bearing, a segmented bearing and a cam follower surface;

a drive roller disposed in said continuous bearing;

a backup roller having a shaft disposed in said segmented bearing, adjacent and parallel to said drive roller, and moveable between an engaged position wherein said backup roller contacts said drive roller to form a nip therebetween, and a retracted position wherein said backup roller does not contact said drive roller, in response to said subunit moving from a closed to an open position; and a biasing member operative to bias said backup roller to the engaged position.

14. The mechanism of claim 13, further comprising a link member having a cam surface pivotally mounted to the shaft of said backup roller, said cam surface operative to engage said cam follower surface as said link member pivots about the axis of said backup roller, to move said backup roller from the engaged to the retracted position.

15. The mechanism of claim 14, further comprising a bell crank connected to said link member and operative to pivot said link member about the axis of said backup roller as said subunit is moved between a closed and an open position.

16. The mechanism of claim 15 wherein said bell crank pivots said link member in response to engaging and disengaging a frame member mounted on said subunit, as said subunit is moved between said closed and open positions.

17. The mechanism of claim 13 wherein said segmented bearing comprises a front segment and a rear segment, wherein said housing further includes a flexible roller holder, and wherein said rear bearing segment is disposed on said flexible roller holder and operative to move between an engaged position wherein said backup roller is proximate said front bearing segment and a retracted position wherein said backup roller is spaced apart from said front bearing segment.

18. A method of releasing a media sheet from nip between two rollers disposed in an image formation apparatus having a subunit movable between closed and open positions, comprising:

engaging and disengaging an element mounted on said subunit with a mechanical linkage disposed in said housing as said subunit is moved between closed and open positions; and in response to engaging or disengaging said element, moving one of said rollers between an engaged position in which it forms a nip with the other said roller and a retracted position in which it is spaced apart from said other roller;

thereby releasing said media sheet from said nip when said one roller is in the retracted position.

19. The method of claim 18 wherein said element is a rotary element and engaging and disengaging said element comprises engaging and disengaging said rotary element with a bell crank member.

20. The method of claim 18 wherein said element is a frame member holding a rotary element and engaging and disengaging said element comprises engaging and disengaging said frame member with a bell crank member.

21. An image forming apparatus having an apparatus housing and a subunit moveable between open and closed positions with respect to said apparatus housing, comprising:

a drive roller and backup roller disposed adjacent and parallel in said apparatus housing;

a transport roller operative to guide a media transport belt; and a mechanical linkage connected to said backup roller and operative to engage and disengage said transport roller, said linkage also operative to move said backup roller between an engaged position wherein said backup roller contacts said drive roller to form a nip therebetween, and a retracted position wherein said backup roller does not contact said drive roller, in response to said mechanical linkage disengaging said transport roller.

* * * * *